US011459745B2

(12) United States Patent
Fry

(10) Patent No.: US 11,459,745 B2
(45) Date of Patent: Oct. 4, 2022

(54) NAIL-THROUGH POLYMER AND METALLIC STRUCTURAL CONNECTORS

(71) Applicant: Shane Fry, Madison, WI (US)

(72) Inventor: Shane Fry, Madison, WI (US)

(73) Assignee: Shane Fry, Madison, WI (US)

( * ) Notice: Subject to any disclaimer, the term of this patent is extended or adjusted under 35 U.S.C. 154(b) by 0 days.

(21) Appl. No.: 16/860,610

(22) Filed: Apr. 28, 2020

(65) Prior Publication Data

US 2020/0340235 A1 Oct. 29, 2020

Related U.S. Application Data

(60) Provisional application No. 62/839,862, filed on Apr. 29, 2019.

(51) Int. Cl.
*E04B 1/41* (2006.01)
*E04B 1/38* (2006.01)

(52) U.S. Cl.
CPC ..... *E04B 1/40* (2013.01); *E04B 2001/405* (2013.01)

(58) Field of Classification Search
CPC ..... E04B 1/40; E04B 2001/405; E04B 1/2612
See application file for complete search history.

(56) References Cited

U.S. PATENT DOCUMENTS 7,028,444 B2 * 4/2006 Wirth ..... E04B 2/721 52/461
7,257,930 B2 * 8/2007 Aldykiewicz, Jr. ..... E04F 15/04 428/343
8,973,334 B2 * 3/2015 Croasdale ..... E04B 1/7629 52/717.02
9,637,911 B2 * 5/2017 Doupe ..... E04B 1/2604
9,874,008 B2 * 1/2018 Doupe ..... E04B 1/2612
11,098,478 B2 * 8/2021 Downs ..... E04B 1/2612
2003/0009980 A1 * 1/2003 Shahnazarian ..... E04C 3/36 52/712
2004/0200184 A1 * 10/2004 Wirth ..... E04F 21/18 52/782.1
2005/0126109 A1 * 6/2005 Aldykiewicz ..... E04F 15/04 52/483.1
2007/0119108 A1 * 5/2007 Downard ..... E04B 5/14 52/289
2008/0202060 A1 * 8/2008 Pilpel ..... E04B 1/2612 52/702
2008/0256884 A1 * 10/2008 Clarizia ..... E04B 1/2612 52/309.3
2012/0192523 A1 * 8/2012 Pilpel ..... E04B 1/2612 52/745.21
2013/0074431 A1 * 3/2013 Croasdale ..... E04B 1/7608 52/272
2016/0002912 A1 * 1/2016 Doupe ..... E04B 1/2604 52/702
2017/0009444 A1 * 1/2017 Downs ..... E04B 1/2608
2017/0138039 A1 * 5/2017 Doupe ..... E04B 1/2612
(Continued)

*Primary Examiner* — Rodney Mintz
(74) *Attorney, Agent, or Firm* — Joseph T. Leone; DeWitt LLP

(57) ABSTRACT

The present invention is a polymer/metallic composite structural connector for use in the construction of framed buildings. The connector includes a metal layer and a polymer layer. While the metal layer provides the conventional connection and structural strength, the polymer layer prevents driven anchors from impacting the metal and damaging either the connector or the anchor.

16 Claims, 14 Drawing Sheets

(56) References Cited

U.S. PATENT DOCUMENTS

| | | | | |
|---|---|---|---|---|
| 2018/0127970 | A1* | 5/2018 | Evans | E04B 1/2612 |
| 2018/0171620 | A1* | 6/2018 | Allen | E04B 1/215 |
| 2021/0032873 | A1* | 2/2021 | Coyle | E04F 13/0833 |

* cited by examiner

NAIL-THROUGH POLYMER AND METALLIC STRUCTURAL CONNECTORS

CROSS-REFERENCE TO RELATED APPLICATIONS

The present application claims priority of U.S. Provisional Patent Application No. 62/839,862, filed on Apr. 29, 2019, the contents of which are incorporated herein by reference in their entirety.

FIELD OF THE INVENTION

Disclosed herein is a polymer/metallic composite structural connector for use in the construction of framed buildings. The connectors can take the form of any conventional framing connector, such as, but not limited to, joist hangers, hurricane clips, ceiling ties, cleats, etc.

BACKGROUND

Building codes throughout the United States require that framed buildings, both residential and commercial, use metallic connectors such as joist hangers and the like to ensure that the building is structurally sound. The building codes are quite specific. They require not only that the such connectors be used, but also specify the minimum number of nails that must be used in each such connector. Conventional connectors are made from steel or aluminum and include pre-formed apertures for purposes of affixing the connector to two or more framing members. The diameter of these pre-formed apertures are relatively quite small. They purposefully match quite closely the diameter of the framing nails required the building codes. Because the apertures are small, it is difficult (if not impossible) and dangerous to send a nail through each aperture using a conventional pneumatic nailing gun.

Because the building codes require that each connector be affixed to the framing members using a minimum number of nails, builders are faced with two options: The first option is to affix the connectors by hand using a hammer. This can be difficult in restricted space, and can also be very slow and tiresome. In larger-scale buildings, this literally requires passing tens of thousands of nails through thousands of joist hangers, L-brackets, and hurricane clips, one at a time. In building construction, as in many professional services, time is money. Thus, while manually installing the connectors is still widely practiced, it is not efficient. The second option is to use a "positive placement" electric or pneumatic nail gun. Positive placement nail guns use either the nail itself to find the aperture in the connector or a probe attached to the tip of the nose-piece of the nail gun to locate the aperture. Once the aperture is located, a squeeze of the trigger then sends the nail through the aperture. Unfortunately, positive-placement nail guns are expensive and require proprietary consumables—i.e., nails organized into cartridges or belts that typically only function with each manufacturer's proprietary nail gun design. Thus, while the cost of the positive-placement nail gun itself might not be prohibitive for commercial builders, the incremental increased cost of hundreds of thousands (or possibly millions) of nails organized into proprietary cartridges is a significant added expense.

Thus, there is a long-felt and unmet need for framing connectors that can be nailed quickly using a conventional nail gun without the added expense of proprietary positive-placement systems.

BRIEF SUMMARY

One embodiment of structural connector device comprises a plurality of vertical panels. Each vertical panel comprises a metal layer comprising a flat or angled sheet of metal, and a plastic layer at least partially covering the metal layer. The plastic layer is connected to the metal layer.

One embodiment of structural connector device comprises at least three vertical panels. Each vertical panel comprises a metal layer comprising a flat or angled sheet of metal, and a plastic layer at least partially covering the metal layer. The plastic layer is connected to the metal layer. One of the vertical panels is connected to at least two other of the three vertical panels along a first vertical edge and a second vertical edge such that the at least three vertical panels extend in parallel.

One embodiment of structural connector device comprises a plurality of vertical panels. Each vertical panel comprises a metal layer comprising a flat or angled sheet of metal, and a plastic layer at least partially covering the metal layer. The plastic layer is connected to the metal layer. At least one connecting panel extends between at least one of the vertical panels and at least one other of the vertical panels.

The objects and advantages of the invention will appear more fully from the following detailed description of the preferred embodiment of the invention and examples.

DETAILED DESCRIPTION

Figure 1:
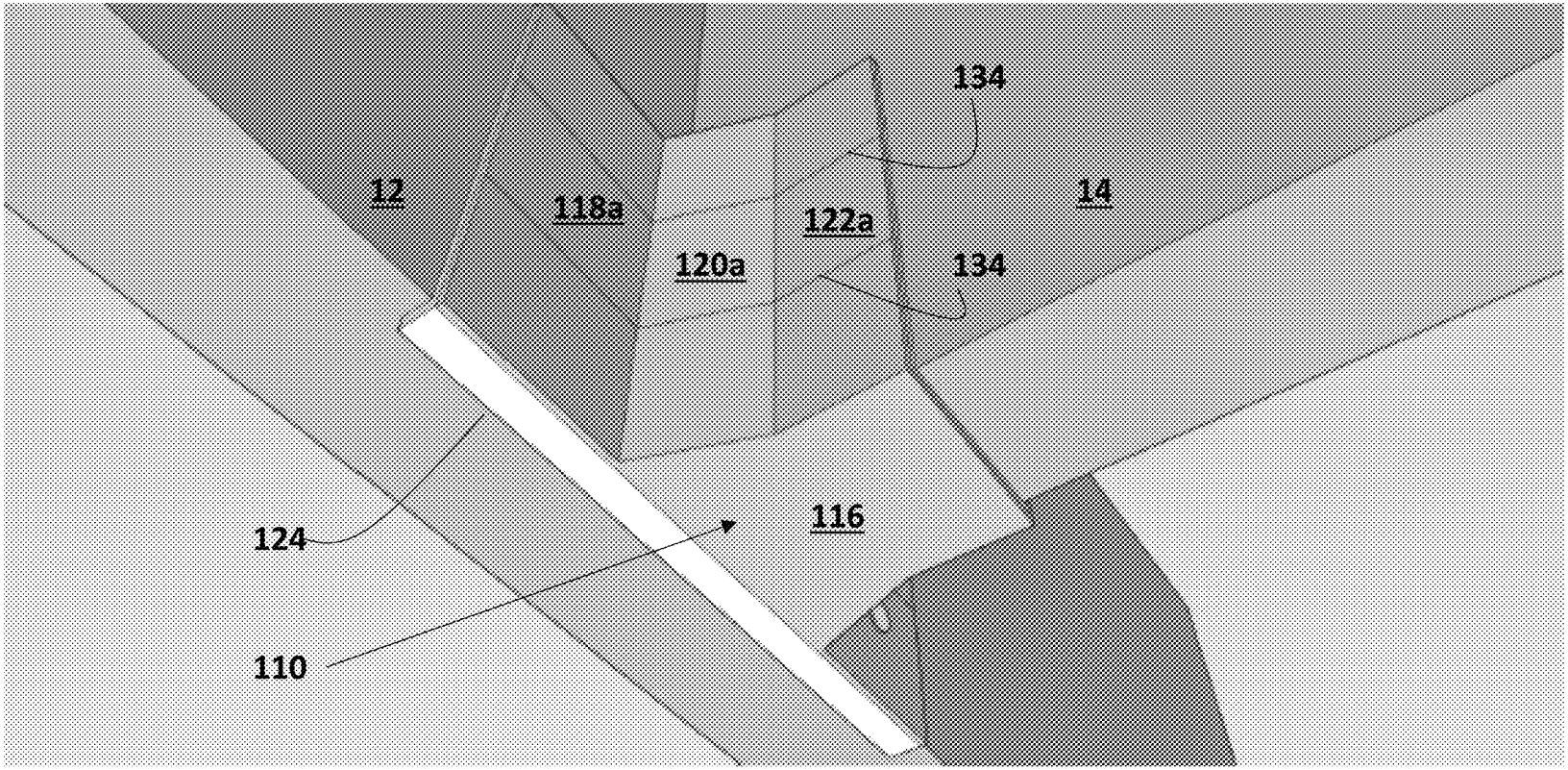
FIG. 1 is a left-side perspective view of an embodiment of a structural connector.
Figure 2:
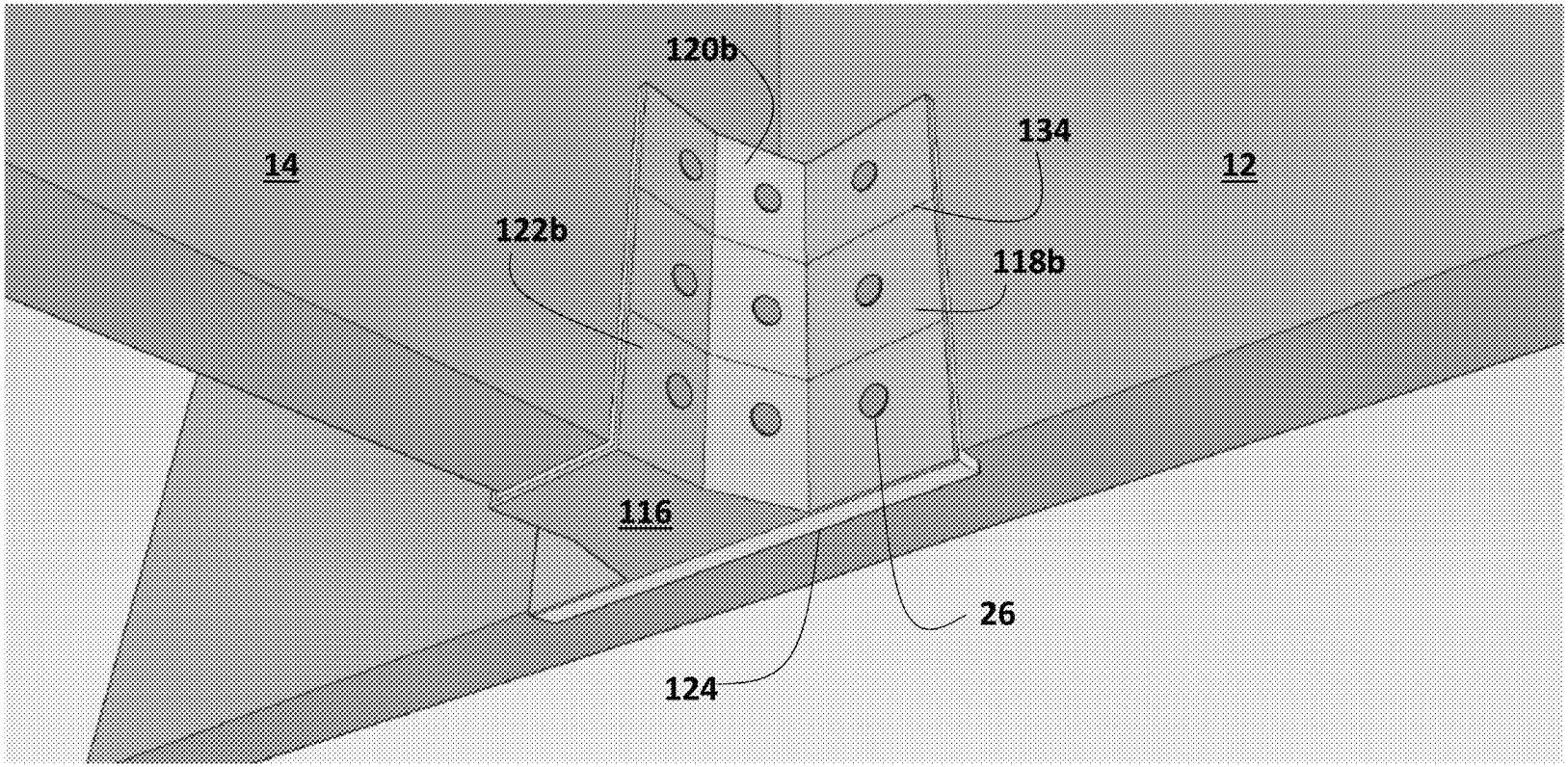
FIG. 2 is a right-side perspective view of the structural connector shown in FIG. 1, as installed.
Figure 3:
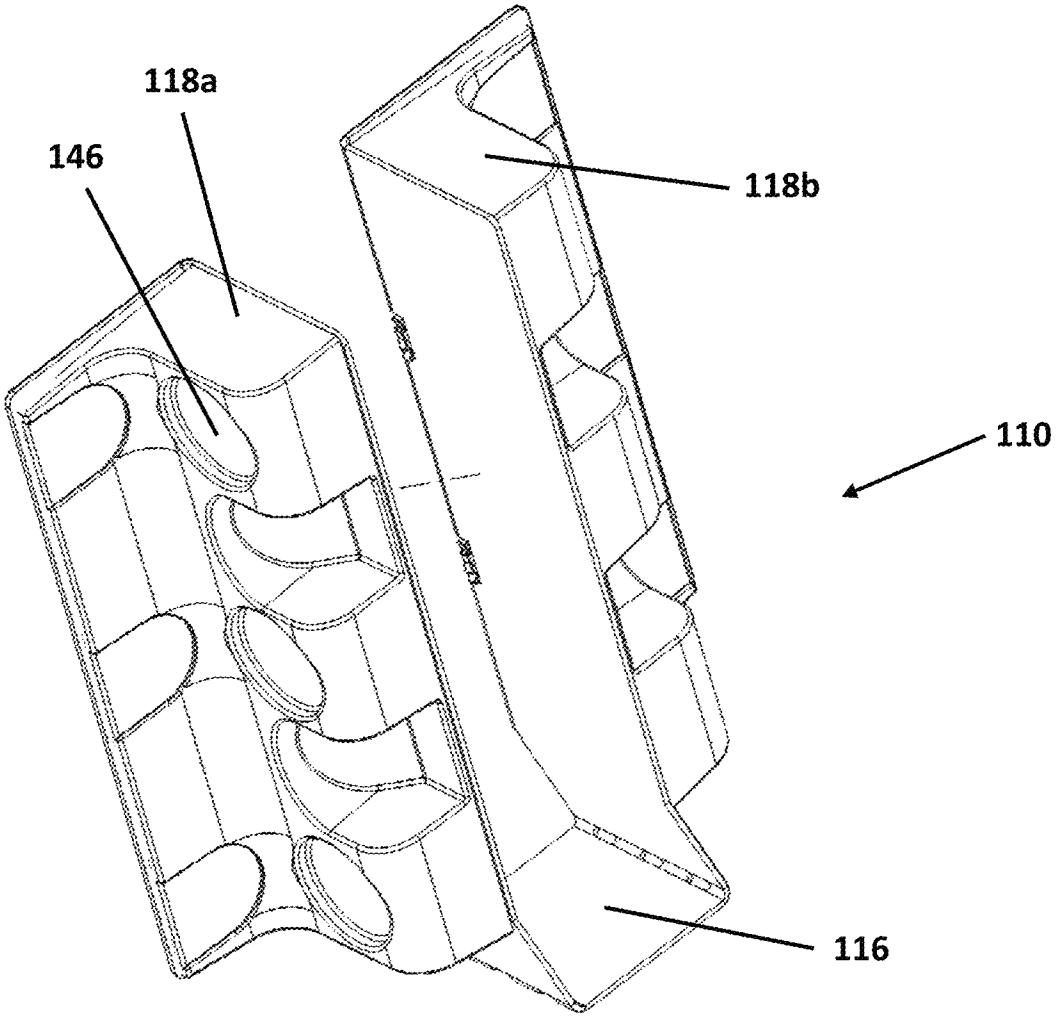
FIGS. 3 and 4 are left-side perspective views of another embodiment of the structural connector shown in FIGS. 1 and 2.
Figure 4:
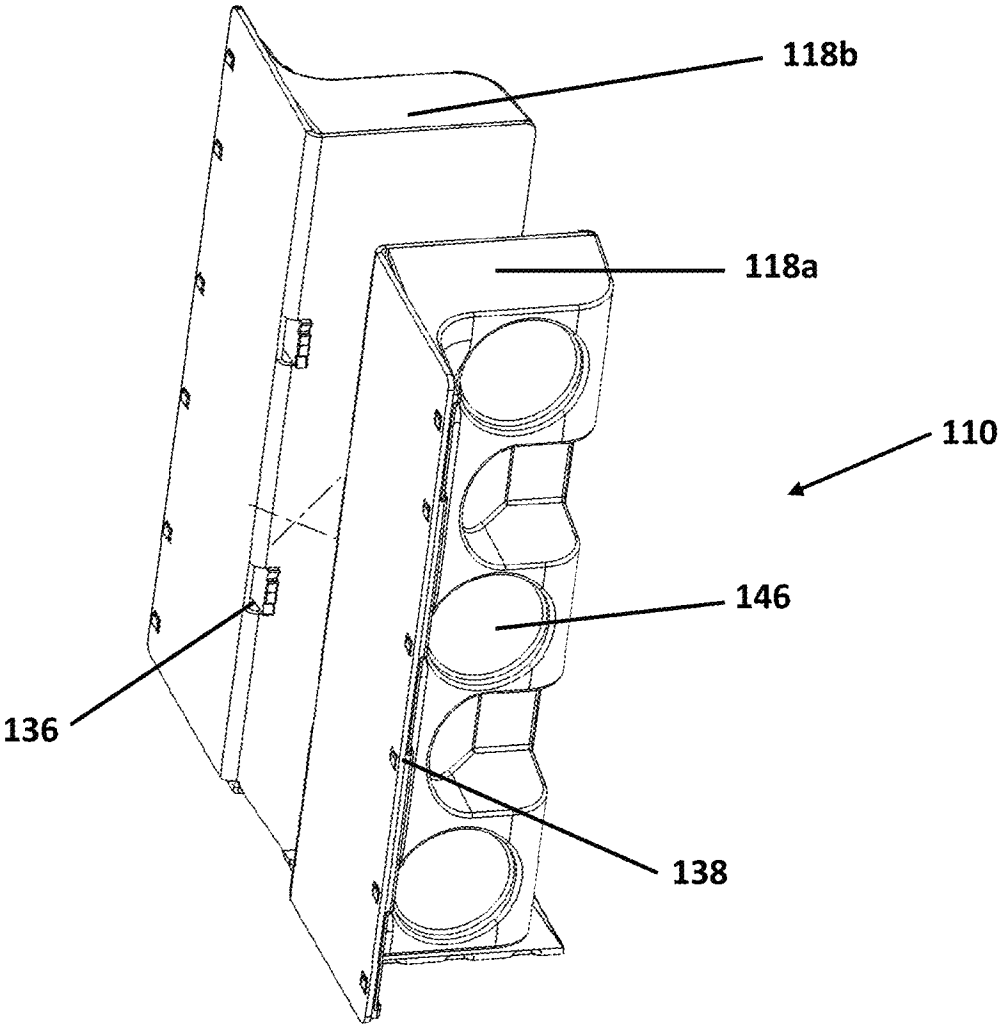

Disclosed herein is a polymer/metallic composite structural connector 100 for use in the construction of framed buildings. Referring now to the drawings, FIGS. 1 and 2 show the structural connector 100 configured as a joist hangar 110 according to the present invention. The joist hangar 110 includes left-side vertical panels 118*a*, 120*a*, and 122*a* (FIG. 1) and corresponding right-side vertical panels 118*b*, 120*b*, and 122*b* (FIG. 2). Panels 118*a* and 118*b* are dimensioned and configured to mount flush against a header joist or ledger 12. Panels 122*a* and 122*b* are dimensioned and configured to mount flush against a floor or ceiling joist 14. Connecting panel 116 extends between and connects panels 120*a* and 122*a* to panels 120*b* and 122*b*. A horizontal flange 124 extends perpendicularly from the bottom edge of panels 118*a* and 118*b* and extends across the edge of panel 116 where it comes in contact with header joist 12. Note that in FIGS. 1 and 2, the header joist 12 and joist 14 are disposed at right angles. This is for ease of illustration only. The header joist 12 and joist 14 may be disposed at any angle (e.g., 60°, 45°, etc.) with the dimensions and configuration of the joist hanger 110 being made accordingly.

The panels 118*a*, 118*b*, 120*a*, 120*b*, 122*a*, and 122*b* may include a nailing grid 134. This can be any type of indicia printed or scored onto the structural connector 100. The nailing grid 134 serves to remind the builders of the minimum number of nails 26 that are required by the building codes for that particular type of structural connector 100. Thus, as shown in FIGS. 1 and 2, the nailing grid 134 defines three zones on each of panels 118, 118*b*, 120, 120*b*, 122, and 122*b*. As shown in FIG. 2, this serves to inform the builder that a nail 26 must be placed in each of the zones created by the nailing grid 134.

Referring now to FIGS. 3 through 8, another embodiment of the joist hangar 110 utilizes left-side vertical panel 118*a* and a corresponding right-side vertical panel 118*b* connected by connecting panel 116. Instead of the nailing grid 134 shown in FIGS. 1 and 2, this embodiment includes guide depressions 146 on an outer surface of the structural connector 100 to guide placement of the tip of the nail 26 and/or nail gun.

Figure 7:
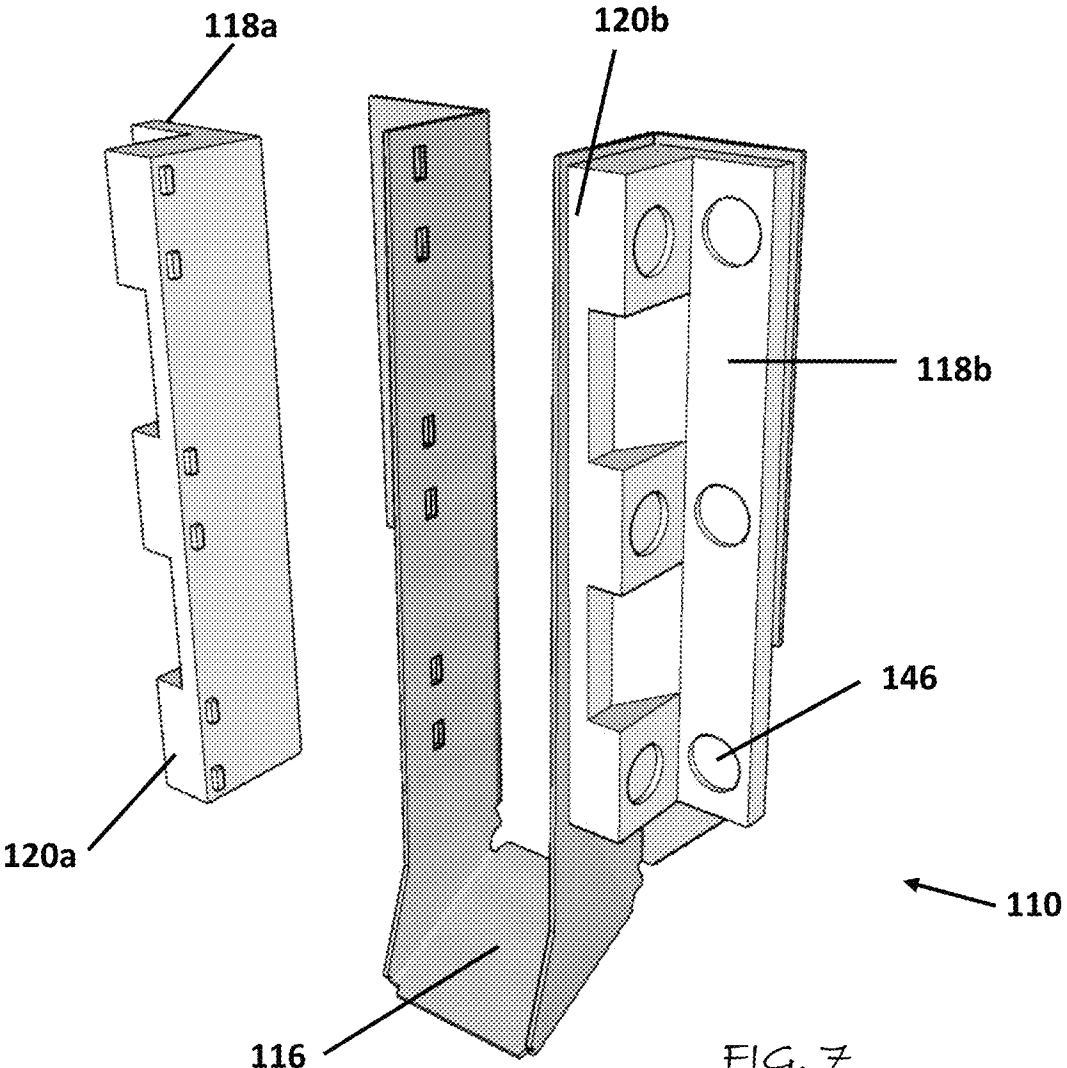
FIGS. 7 and 8 are right-side perspective views of another embodiment of the structural connector shown in FIGS. 1 and 2.
Figure 8:
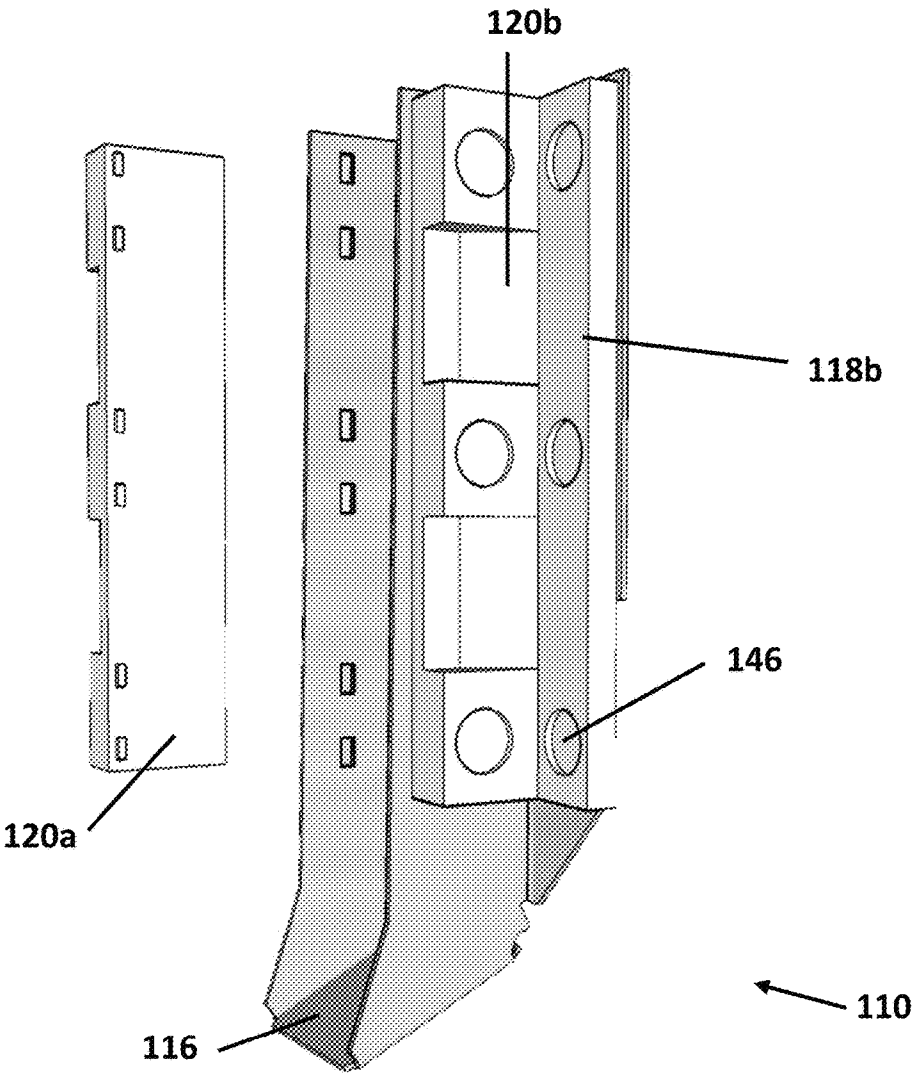

Referring now to FIGS. 7 and 8, another embodiment of the joist hangar 110 utilizes left-side vertical panels 118*a* and 120*a*, and corresponding right-side vertical panels 118*b* and 120*b*. This embodiment also includes guide depressions 146 as above. In addition, the embodiment shown in FIGS. 7 and 8 shows an angled connecting panel 116 which connects panels 118*a* and 120*a* to panels 118*b* and 120*b*. Such a configuration allows attachment to an angled floor or ceiling joist 14.

Figure 9:
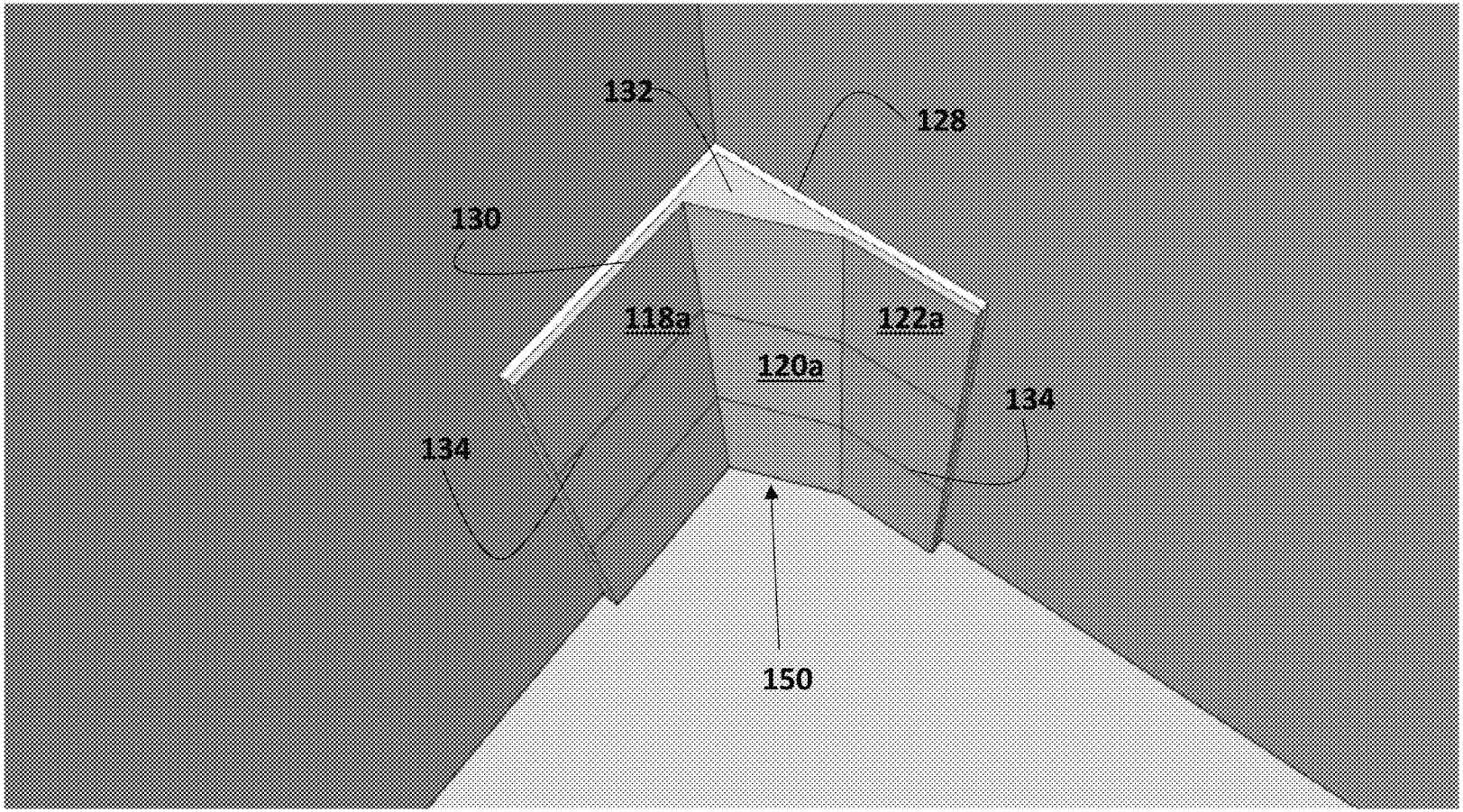
FIG. 9 is a perspective view of another embodiment of a structural connector.
Figure 10:
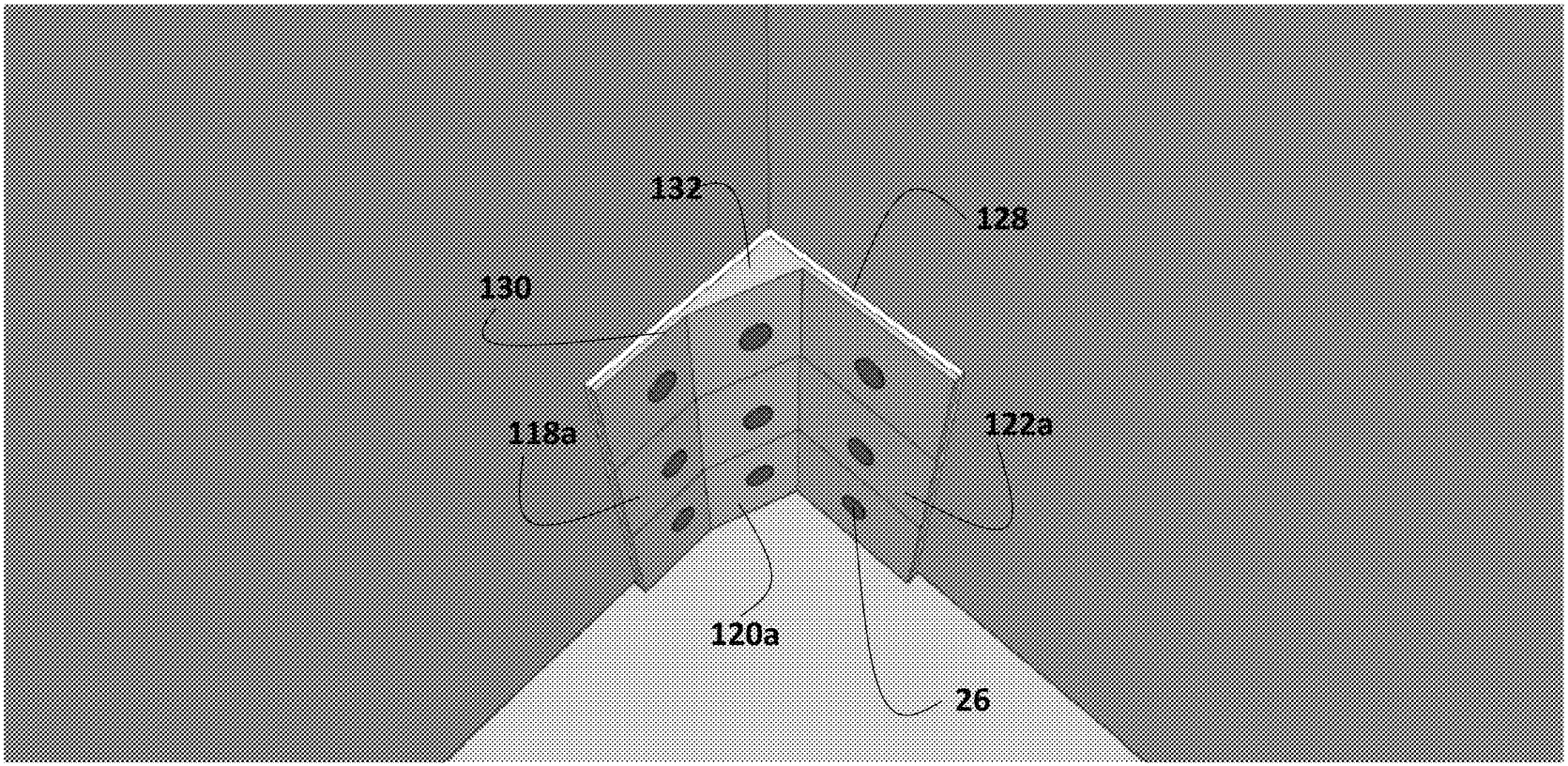
FIG. 10 is a perspective view of the structural connector of FIG. 9, as installed.

Referring now to FIGS. 9 and 10, these two figures show the structural connector 100 configured as a corner bracket 150, further illustrating the unique construction of the structural connector 100. Here, the bracket again has three panels, 118*a*, 120*a*, and 122*a*, with the three panels configured to define a 90° angle. (Again, the 90° angle is for illustration purposes only. The bracket 150 can be configured to any desired angle, such as, but not limited to, 45° or 30°.)

Figure 11:
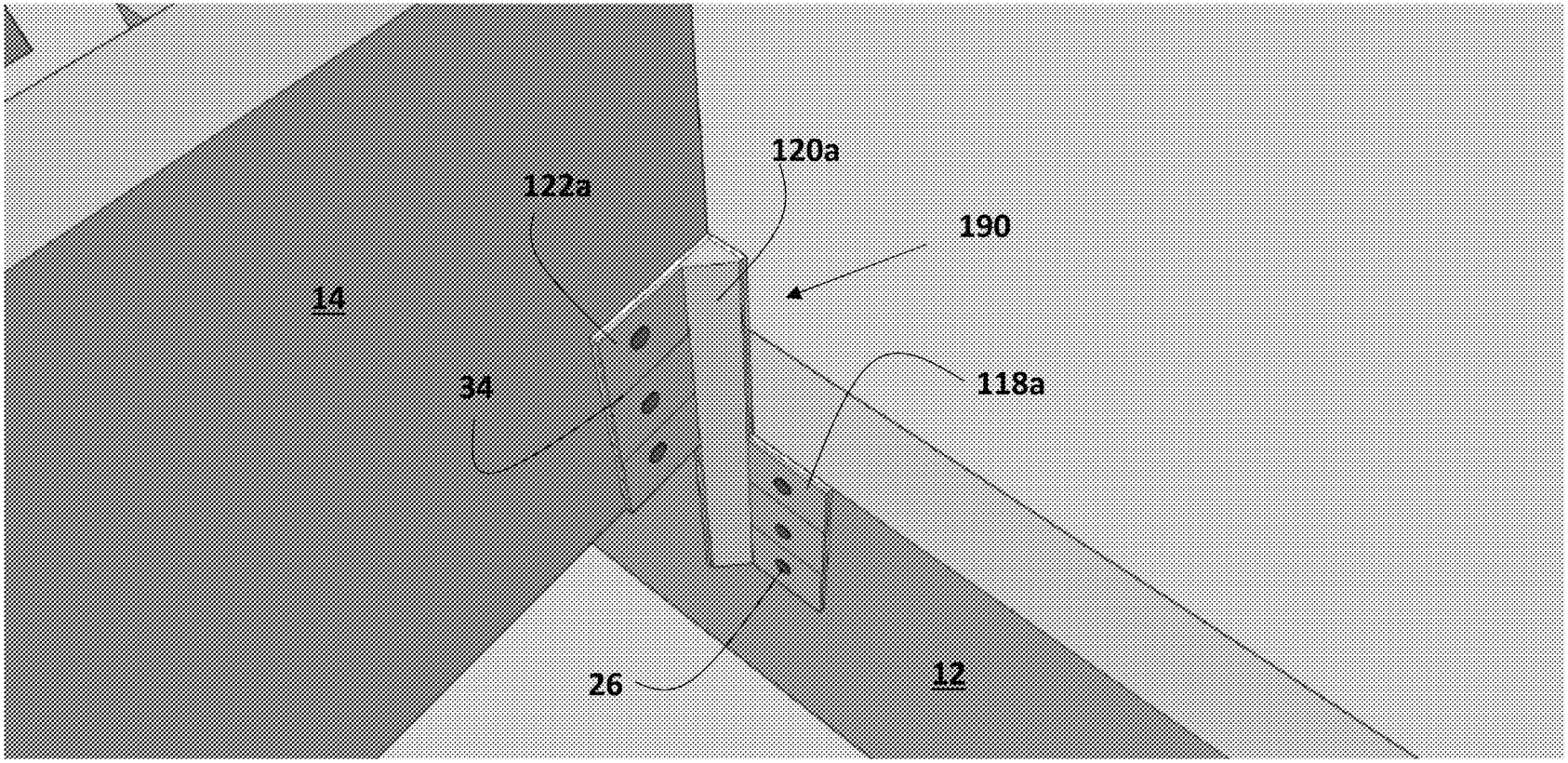
FIG. 11 is a perspective view of another embodiment of a structural connector.

Referring now to FIG. 11, this figure shows the structural connector 100 configured as a hurricane tie 190, further illustrating the unique construction of the structural connector 100. Here, the bracket again has three vertical panels 118*a*, 120*a*, and 122*a*, with panel 118*a* being at a different level along panel 120*a* from panel 122*a*. The connection between panels is configured to define a 90° angle. (Again, the 90° angle is for illustration purposes only. The hurricane tie 190 can be configured to any desired angle, such as, but not limited to, 45° or 30°.)

Figure 12:
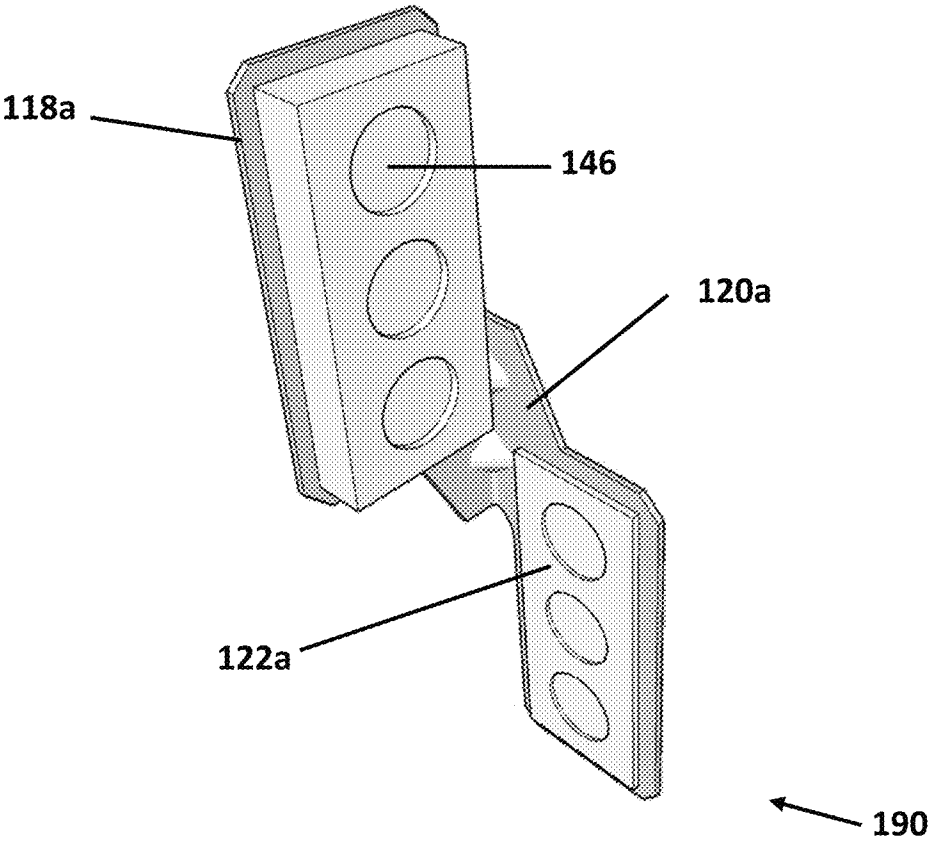
FIGS. 12 and 13 are perspective views of another embodiment of the structural connector shown in FIG. 11.
Figure 13:
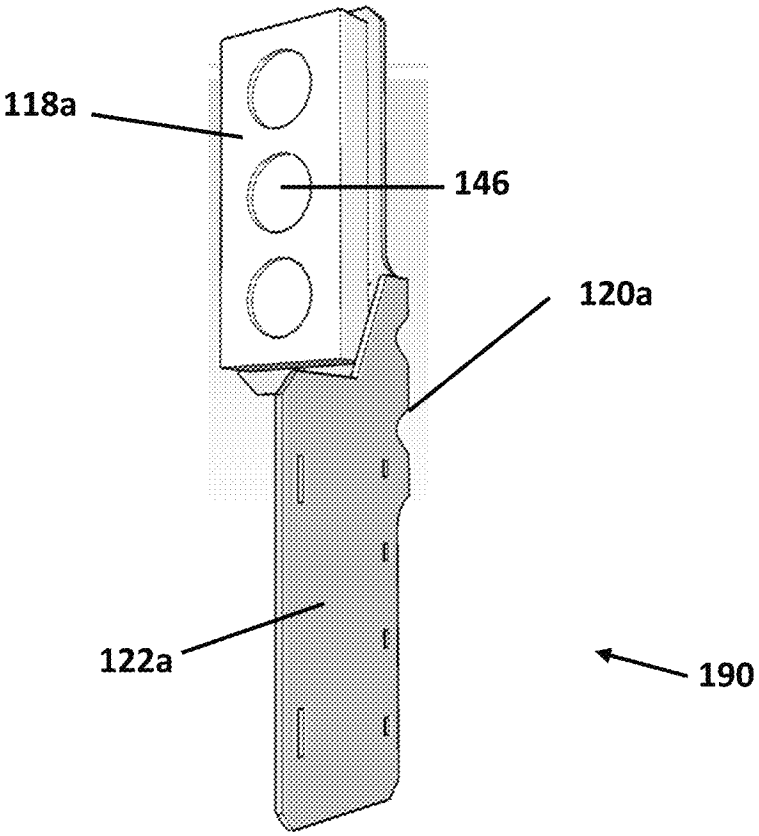
Figure 14:
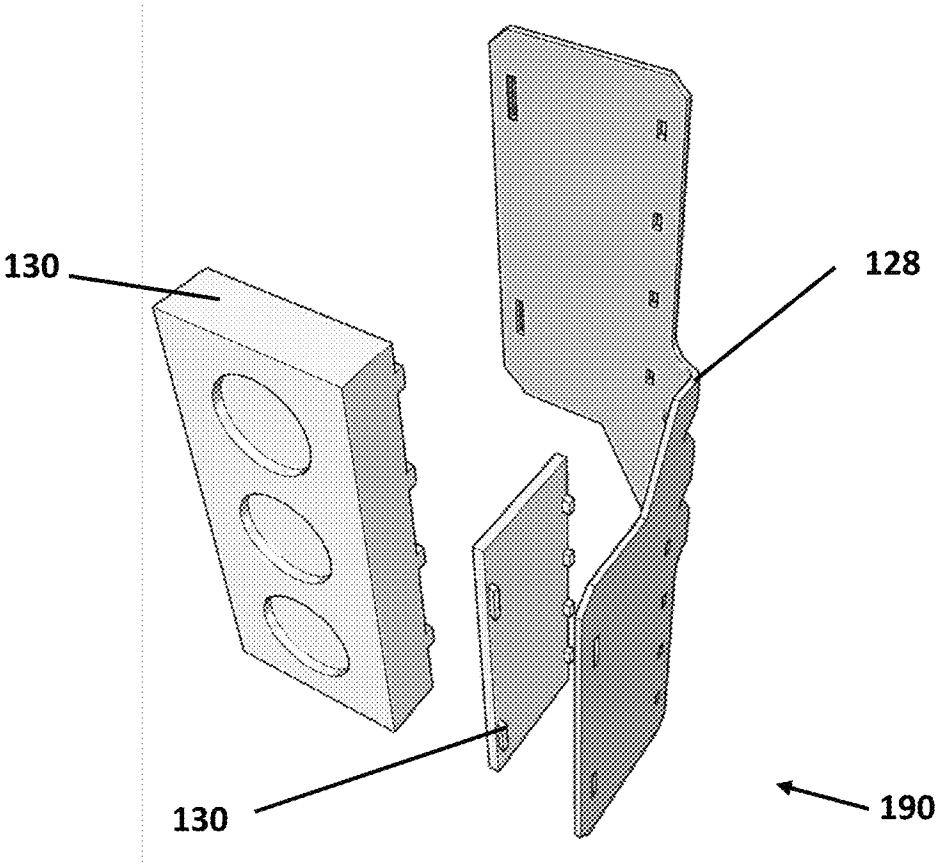
FIG. 14 is an exploded view of the embodiment of the structural connector shown in FIGS. 12 and 13.

Referring now to FIGS. 12 through 14, another embodiment of the hurricane tie 190 also utilizes three vertical panels 118*a*, 120*a*, and 122*a*, with panel 118*a* being at a different level along panel 120*a* from panel 122*a*. This embodiment includes guide depressions 146 on an outer surface of the structural connector 100 to guide placement of the tip of the nail 26 and/or nail gun.

Each structural connector 100 (for example 110 in FIGS. 1-8, 150 in FIGS. 9 and 10, and 190 in FIGS. 11-14) is fabricated with a metal layer 128 that contacts the framing members to which the connector 100 will be attached. The metal layer 128 is overlaid, laminated, or glued in face-to-face orientation with an outward-facing polymer layer 130. Certain embodiments may utilize interlocking, snap-fit, or friction-fit combinations of tabs 136 and/or apertures 138. Such combinations may be arranged to only allow use of a specific polymer layer or layers 130 and/or require a particular orientation of the polymer layer 130. While the exemplary embodiments utilize tabs on polymer layer 130 and corresponding apertures on metal layer 130, the reverse, or a combination of tab 136 and aperture 138 on each layer may be used. Other interlocking structures guiding placement of polymer layer 130 on metal layer 128 are also contemplated.

Figure 5:
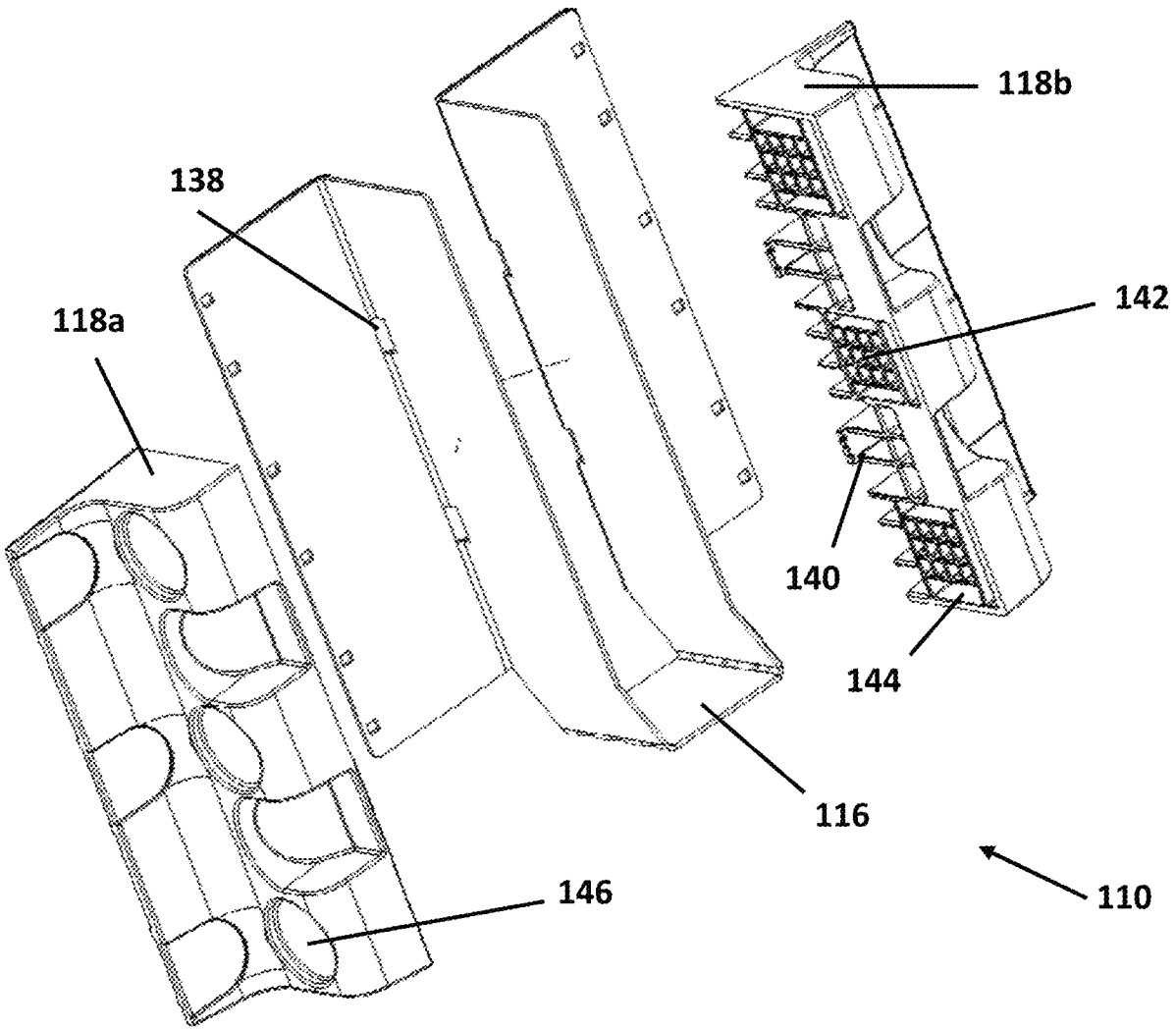
FIGS. 5 and 6 are front and rear exploded views of the embodiment of the structural connector shown in FIGS. 3 and 4.
Figure 6:
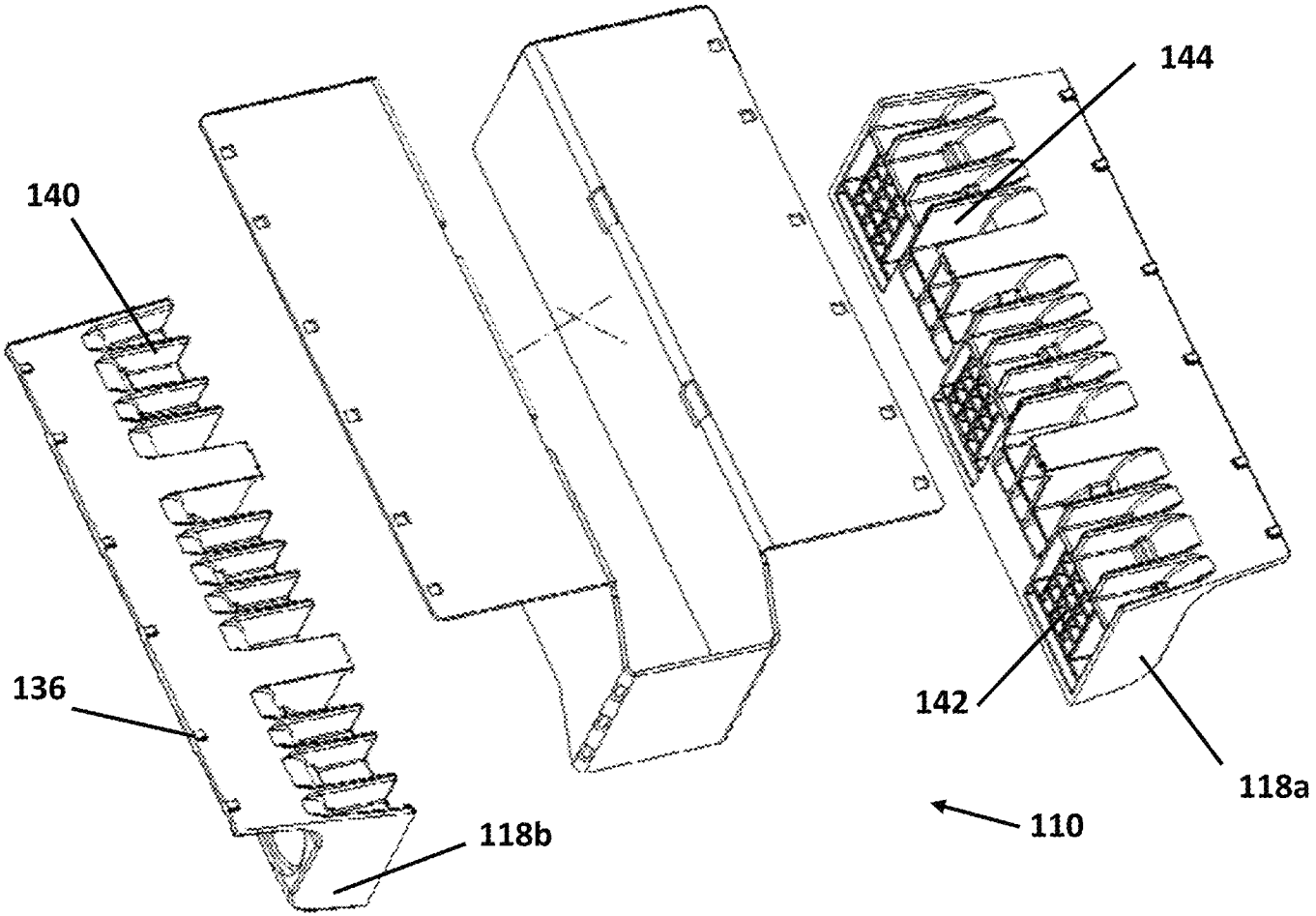

The polymer layer 130 may be of a uniform thickness, as shown at reference 130 in FIG. 9-11. It may also be gusseted, or of non-uniform thickness, especially near a corner, as shown at reference 132 in FIG. 9-11. To save material and weight, reinforcing fins 140 or a reinforcing lattice 142 may be formed in a cavity 144 in polymer layer 130 instead of solid layer of polymer, as shown in FIGS. 5 and 6. As shown the polymer layer 130 is not necessarily continuous and may be formed in separate, discrete segments. In such embodiments, portions of the vertical panels 118*a*-122*b* and/or the connecting panel 116 may comprise metal layer 128 only. Such separate segments may also have different polymer thicknesses, as shown in FIGS. 12 and 14. The polymer layer 130 may also be interchangeable on the metal layer 128, to allow different configurations of polymer thickness, as well as placement and/or number of nails 26 used with the connector 100. Such interchangeability may also be used to allow different configurations of metal layer 128 while keeping the same polymer layer 130.

The metal layer 128 may be made from any suitable rigid metal, such as, but not limited to, steel, galvanized steel, aluminum, and the like. The metal layer 128 is dimensioned and configured to be thick enough to add structural rigidity and fire resistance to the connector, yet thin enough that a framing nail 26 propelled by a conventional nail gun will have sufficient strength to pass through the metal layer 128 and seat fully within the framing members.

The polymer layer 130 may be made from any thermoplastic or thermosetting polymer, without limitation. Preferred polymers include thermoplastic and thermosetting poly(alkylenes), such as, but not limited to, polyethylene, polypropylene, etc., poly(amides) such as, but not limited to, "Nylon"-type polymers, halogenated polymers such as, but not limited to, Teflon-type halogenated polymers (e.g., polytetrafluoroethylene), elastomers, and the like. Mixtures of polymers, blends, and co-polymers of any description may be used in the polymer lawyer 130. The polymer layer 130 serves as a bed into which the heads of the nails 28 will seat when the connector is attached to a framing member. See for example FIGS. 2 and 4. The polymer used in the polymer layer 130 need not be virgin polymer. The polymer layer 130 may be fabricated from recycled plastics, such as, but not limited to, mixed, post-consumer recycled waste plastic.

In combination, the metal layer 128 and the polymer layer 130 work together to provide the proper shape, strength, and structural integrity to the connector 100 in case of fire or overloaded conditions. The polymer layer 130 provides a safe surface for driving a nail using a nail gun because the nail head will not be driven onto a metal surface (which can be dangerous). Rather, once the shaft of a nail 26 penetrates through the polymer surface 130 and the metal surface 128, the head of nail 26 abuts against and lightly compresses the polymer surface 30. In this fashion, the head of nail 26 positively interacts with the connector 100 without contacting any metallic surface of the connector 100. The overall thickness of the combined metal layer 128 and polymer layer 130 is such that a nail 26 can be driven through the connector 100 using conventional, non-positive placement nail guns (or by hand using a hammer). Because the connectors 100 disclosed herein do not include any pre-formed apertures, there is no need to fill in any unused apertures (which is the case with conventional connectors.)

Any version of any device element or system component or method step of the invention may be used with any other device element, system component, or method step of the invention. The device elements, system components, and method steps described herein can be used in any combination whether explicitly described or not.

As used herein, the singular forms "a," "an," and "the" include plural referents unless the content clearly dictates otherwise. Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, patent applications, and peer-reviewed publications (i.e., "references") cited herein are expressly incorporated by reference in their entirety to the same extent as if each individual reference were specifically and individually indicated as being incorporated by reference. In case of conflict between the present disclosure and the incorporated references, the present disclosure controls.

The devices, methods, compounds and compositions of the present invention can comprise, consist of, or consist essentially of the essential elements and limitations described herein, as well as any additional or optional steps, ingredients, components, or limitations described herein or otherwise useful in the art.

While this invention may be embodied in many forms, what is described in detail herein is a specific preferred embodiment of the invention. The present disclosure is an exemplification of the principles of the invention is not intended to limit the invention to the particular embodiments illustrated. It is to be understood that this invention is not limited to the particular examples, process steps, and materials disclosed herein as such examples, process steps, and materials may vary somewhat. It is also understood that the terminology used herein is used for the purpose of describing particular embodiments only and is not intended to be limiting since the scope of the present invention will be limited to only the appended claims and equivalents thereof.

What is claimed is:

1. A connecting system, comprising:

a structural connector device configured to connect framing members, the structural connector device comprising:

a plurality of vertical panels, each vertical panel comprising:

a metal layer comprising a flat or angled sheet of metal, a plastic layer having a variable thickness at least partially covering the metal layer, wherein the plastic layer is connected to the metal layer; and at least one connecting panel extending perpendicularly between at least one of the plurality of vertical panels and at least one other of the plurality of vertical panels;

wherein the plastic layer does not contact the framing members; and wherein the structural connector device is dimensioned and configured to connect the framing members.

2. The system of claim 1, wherein the plastic layer is non-continuous between the plurality of vertical panels.

3. The system of claim 1, wherein the variable thickness of the plastic layer is located between the plurality of vertical panels.

4. The system of claim 1, wherein the variable thickness of the plastic layer is located along a single vertical panel.

5. The system of claim 1, wherein the plastic layer comprises at least one reinforcing fin extending through or across a cavity in the plastic layer.

6. The system of claim 1, wherein the plastic layer comprises at least one reinforcing lattice extending through or across a cavity in the plastic layer.

7. The system of claim 1, wherein the plastic layer is connected to the metal layer by a layer of adhesive extending between the plastic layer and the metal layer.

8. The system of claim 1, wherein the plastic layer is connected to the metal layer by at least one nail extending through the plastic layer and into the metal layer.

9. The system of claim 1, further comprising at least one guide depression in an outer surface of the plastic layer.

10. The system of claim 1, further comprising at least one nailing guide printed or etched on an outer surface of the plastic layer.

11. The system of claim 1, wherein the plastic layer is connected to the metal layer by at least one interlocking structure.

12. The system of claim 11, wherein the plastic layer is connected to the metal layer by at least one tab extending from one of the plastic layer and the metal layer into at least one aperture in the other of the plastic layer and the metal layer.

13. The system of claim 11, wherein the plastic layer is removably connected to the metal layer.

14. A connecting system, comprising:

a structural connector device configured to connect framing members, the structural connector device comprising:

at least three vertical panels, each vertical panel comprising:

a metal layer comprising a flat or angled sheet of metal, a plastic layer having a variable thickness at least partially covering the metal layer, wherein the plastic layer is connected to the metal layer; and at least one connecting panel extending perpendicularly between at least one of the at least three vertical panels and at least one other of the at least three vertical panels;

wherein the plastic layer does not contact the framing members;

wherein the structural connector device is dimensioned and configured to connect the framing members; and wherein one of the at least three vertical panels is connected to at least two other of the at least three vertical panels along a first vertical edge and a second vertical edge such that the at least three vertical panels extend in parallel.

15. The system of claim 14, wherein the at least three vertical panels extend vertically along a same vertical level.

16. The system of claim 14, wherein the at least three vertical panels are vertically staggered.

* * * * *